United States Patent [19]

Thompson

[11] 3,990,616

[45] Nov. 9, 1976

[54] DRYER AND SHAPER SUPPORT FOR CLOTHING

[76] Inventor: Philip W. Thompson, 4809 Bayonne Ave., Baltimore, Md. 21206

[22] Filed: Dec. 23, 1975

[21] Appl. No.: 643,742

[52] U.S. Cl. ..... 223/77

[51] Int. Cl.[2] ..... D06C 5/00

[58] Field of Search ..... 223/61, 57, 70, 75–77, 223/63, 65

[56] References Cited

UNITED STATES PATENTS

| | | | |
|---|---|---|---|
| 2,175,661 | 10/1939 | Gordon | 223/77 |
| 2,545,479 | 3/1951 | Loutz | 223/77 |

*Primary Examiner*—G. V. Larkin

*Attorney, Agent, or Firm*—John F. McClellan, Sr.

[57] ABSTRACT

A dryer and shaper support for clothing which is particularly adapted for drying and shaping amputee stump socks; the unit includes a frame having means for hanging the frame, a downwardly extending rounded, perforate lower portion, and horizontally disposed opposed clamps acting against the top of the frame; in a preferred embodiment the frame adjusts vertically and laterally to accommodate different size garments and the lateral adjustment is held by friction of the clamps.

11 Claims, 7 Drawing Figures

DRYER AND SHAPER SUPPORT FOR CLOTHING

This invention relates generally to supports and particularly to clothing supports.

A principal object of the invention is to provide a dryer and shaper for amputee stump socks, which precisely shapes them to a predetermined desired configuration. Exact conformance to a predetermined size and shape is very important to comfort in wearing such socks, and is difficult to achieve, particularly with wool socks, which are a preferred type for this application. Further objects are to provide a dryer and shaper as described which is convenient and easy to adjust and to use, which is symmetrically adjustable, which is economical to manufacture, which is durable and is neat in appearance, and which requires minimum space.

In brief summary given for cursive description only, the invention includes perforate shield-shaped frame having clamping means at the top, means for supporting, and in preferred embodiment means for adjusting both width and length.

The above and other objects and advantages will become more readily apparent on examination of the following description, including the drawing, in which like reference numerals refer to like parts:

Figure 1:
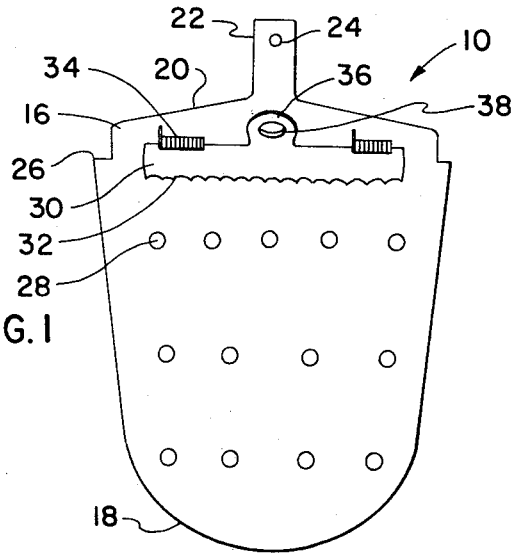
FIG. 1 is a front elevational view of a first embodiment.
Figure 2:
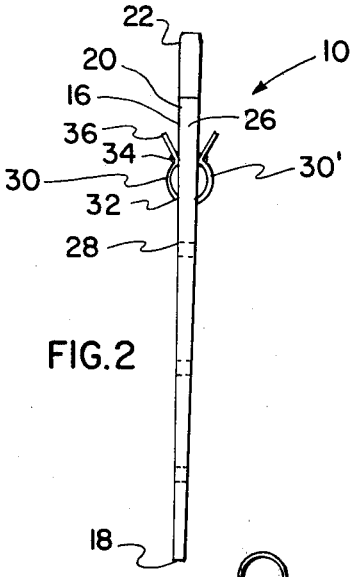
FIG. 2 is a side elevational view thereof.

FIG. 1 and FIG. 2 show the structure of embodiment 10 of the invention. Frame 16 is a plate, shield shaped and generally planar on both faces, symmetrical about the vertical centerline in both views, with a rounded lower portion 18, a generally transverse top portion 20 with an upward protrusion 22 in the center having a hole 24 for hanging the unit. Preferably a notch 26 is provided at each upper corner, facilitating garment alignment and grasping. In face view the frame tapers, lessening in width in the downward direction.

In side profile the structure preferably tapers also, from thicker at the top to thinner at the bottom, making it easier to draw a wet sock over it accurately into place for shaping and drying. Perforations 28 through the frame make drying faster.

A clamp 30 extends across the face of the frame at the top, nearly from side-to-side. The lower edge 32 of the clamp bears against the frame in position to retain the upper edge of a sock on the frame. The clamp has a generally hemi-cylindrical profile at the bottom, arching outward and upward for clearance and then inward where it secures to the frame by two spring-loaded hinges 34 which bias the lower edge against the frame. The lower edge is preferably serrated as shown, to improve holding. Clamp handle 36 extends outwardly from the center at an oblique upward angle and has a central perforation 38, helping to prevent slippage when depressing it to release the clamp.

A second clamp 30' mounts on the opposite face of the frame, opposed to the first in location. This arrangement not only provides uniform support but also permits both clamps to be opened at the same time, by squeezing the handles toward each other with one hand. Material for the unit may be wood, plastic or metal.

Figure 3:
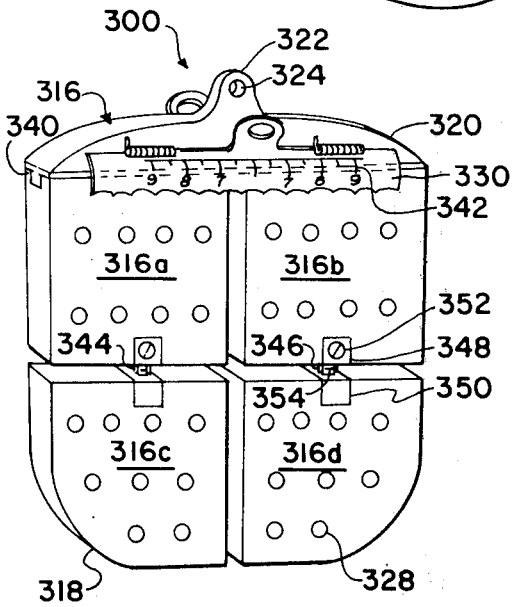
FIG. 3 is an isometric view of a second embodiment.

FIG. 3 illustrates embodiment 300 which provides a pre-settable length-adjustment and quick-set width adjustment.

The frame 316 comprises five parts, the top portion 320 which extends across the width has an upward protrusion 322 with hole 324 for hanging and mounts opposed clamps 330, 330' (handle shown) as before. The clamp lower edges however grip between them first or upper portions which may be quadrants as at **316*a*, 316*b*, each of which is about one-half the width of the assembly and both are held slidably on a dovetail track 340 fixed along the lower edge of the top portion. This permits a sock to be stretched laterally to any desired degree, by fitting it loosely over the unit and under the clamps, then separating the upper quadrants with one hand as by forcing apart the upper quadrants at the junction between them, while relieving pressure on the clamps with the other hand. When the desired degree of stretch is imparted, the clamps are released, holding the stretching force on the sock. Symmetrical graduations 342** on the clamps provide a guide enabling reproducing the amount of stretch each time. Removal of the sock when dry and shaped is rapid and easy. The clamps are squeezed, simultaneously relieving both clamping and stretching pressure, so that the sock is not distorted out of shape when removed.

Respective second or lower quadrants **316*c*, 316*d* generally corresponding in size with the upper quadrants depend respectively from the upper quadrants on a vertical slide-track 344, 346** preferably located about the mid-width. Each vertical slide track may be fixed in a lower quadrant and may extend into a fitting recess in the corresponding upper quadrant.

The slide track mounting structure and recess structure may be provided as an integral part of the structure of the quadrants, or alternatively, insets 348, 350 may be provided for sturdier and more economical construction. A set-screw 352 threaded into the face of the unit provides for clamping the slides after length adjustment, and graduations 354 indicate length set. Rounded lower outboard corners 318 on the lower quadrants ease sock installation and shape the sock being stretched and dried.

Perforations 328 through the quadrants and the separations between quadrants make drying faster even though the unit provides nearly as much shaping local support as the previous embodiment.

Figure 4:
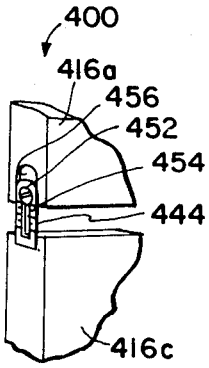
FIG. 4 is an isometric detail of a third embodiment.

FIG. 4 details the difference between a further embodiment 400 and the previous embodiment. In this further embodiment, typically, a slide structure 444 along the outboard edge connects the upper and lower quadrants **416*a*, 416*c*. A set screw 452 and graduations 454 provide for clamping at a desired setting. The markings of the graduation are more visible in this embodiment. The slide structure preferably has a recess 456** in which to travel in the quadrant, to prevent snagging socks being placed on or removed from the unit.

Figure 5:
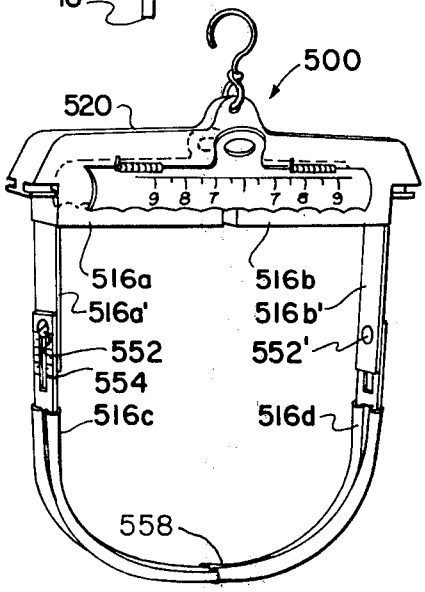
FIG. 5 is an isometric view of a fourth embodiment.

FIG. 5 illustrates embodiment 500 which has a top 520 and frame quarters generally like the previous embodiment except that the upper portions **516*a*, 516*b* are abbreviated vertically, being wider than the vertical dimension, and include respective integral downward straps 516*a'* and 516*b'* and the lower portions 516*c*, 516*d* comprise tubular, slotted strap arcs downwardly depending from the outboard ends of the upper portions and having a horizontal, sliding overlapping interfit 558** where they round out and turn inward to each other at the bottom of the frame. This provides for width adjustment in similar manner to the previous embodiment but with different, connected-but-open structure.

Lower portion 516*c* has a figure-eight cross section slidably securely receiving the double-tube cross section of lower portion 516*d*.

At the junctions, the upper and lower portions vertically overlap and are secured by setscrews 552, 552′, provide length adjustment indicated by graduations 554, one piece being a tubular guide fitting the other piece.

It can be seen that the width adjustment is flexibly achievable in the manner previously indicated, clamping at the top, and that the vertical adjustment is presettable as described.

Figure 6:
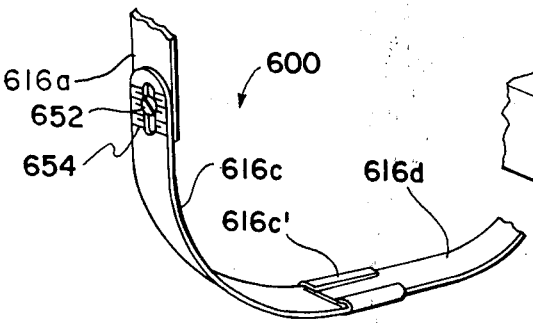
FIG. 6 is an isometric detail of a fifth embodiment.

FIG. 6 illustrates by detail a further embodiment 600 similar to that of the previous Figure except for two variations.

At the vertical overlap the parts are simple straps, one 616*c* being slotted and the other 616*a* having a tapped hole for clamping screw 652 which holds the setting. Graduations 654 indicate the setting as before.

At the horizontal overlap, one lower portion 616*d* is a simple strap and the other 616*c* has a turned edges 616*c′* forming a channel to receive the other lower quarter for slidable adjustment.

Figure 7:
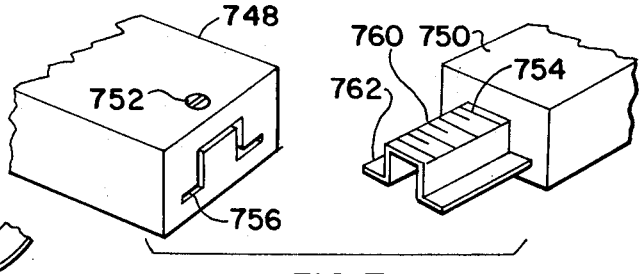
FIG. 7 is an isometric detail of an adjustable fastening arrangement.

FIG. 7 illustrates details of slide adjustment structure usable with embodiments 300 or 400 above, the fixed portion being a metal channel 760 with a right angle outward flange 762 on each leg, protruding from a plastic or other member 750 to which it is fixed as by molding it in place. Transverse graduations 754 may be provided on one or both faces. Slidably receiving the channel is a corresponding piece 748 having a recess 756 shaped for receiving the channel in a sliding fit, and a set screw 752 in a hole threaded transversely through to the recess for locking the channel at any desired adjustment.

This invention is not to be construed as limited to the particular forms disclosed herein, since these are to be regarded as illustrative rather than restrictive. It is, therefore, to be understood that the invention may be practiced within the scope of the claims otherwise than as specifically described.

What is claimed and desired to be secured by U.S. Letters Patent is:

1. A dryer and shaper for amputee stump socks, comprising: a perforate shield-shaped frame having first and second faces, a rounded lower portion, a laterally extending top portion, means for connecting the rounded lower portion and laterally extending top portion, means for supporting the frame, a first clamp operably mounted on the laterally extending top portion on the first face, a second clamp operably mounted on the laterally extending top portion on the second face, and said clamps having respective lower edges thereof opposed in location.

2. A dryer and shaper as recited in claim 1, additionally including means for adjustably widening a portion of the frame comprising: the lower portion having division into first and second laterally related parts, means mounting the lower portion laterally related parts movably with respect to each other along the lateral extent of the top portion and all said clamp lower edges clamping between them the lower portion laterally related parts.

3. A dryer and shaper as recited in claim 2, each lower portion part having division into first and second portions in vertical relation and said means for connecting including means for adjustably mounting each first portion movably in a vertical direction with respect to a respective second portion.

4. A dryer and shaper as recited in claim 3, each said clamp having a handle upwardly and outwardly protrusive therefrom all said handles being proximately opposed in location, for permitting simultaneous operation of the clamps by squeezing one said handle toward the other said handle.

5. A dryer and shaper as recited in claim 3, at least one clamp having graduations laterally therealong for indicating relative positioning of the laterally related parts.

6. A dryer and shaper as recited in claim 5, at least one means for adjustably mounting a first portion to a second portion having adjustment-indicating graduations thereon.

7. A dryer and shaper as recited in claim 4, all said portions comprising perforate quadrants.

8. A dryer and shaper as recited in claim 4, said first portions being wider than the vertical dimension thereof and having respective integral downward straps, said second portions comprising strap arcs downwardly depending from respective overlaps with said respective integral downward straps and inwardly turning at the bottom of the frame to an overlap with each other, and all said overlaps having means for securing.

9. A dryer and shaper as recited in claim 8, said means for securing the overlap at the bottom of the frame providing a sliding fit between the respective second portion inward turns.

10. A dryer and shaper as recited in claim 9, the means for supporting the frame including an upward projection centrally of the top portion, and means for hangingly engaging the upward projection.

11. A dryer and shaper as recited in claim 1, the frame being symmetrical about the vertical centerline in elevational face view and tapering down in width from top to bottom, and the frame being symmetrical about the vertical centerline in side elevational view and tapering down in thickness from top to bottom.

* * * * *